US005461285A

United States Patent [19]

Schleijpen et al.

[11] Patent Number: 5,461,285

[45] Date of Patent: Oct. 24, 1995

[54] SWITCHING ARRANGEMENT

[75] Inventors: Franciscus A. M. Schleijpen; Robertus A. J. Keijser; Machiel A. M. Hendrix, all of Eindhoven, Netherlands

[73] Assignee: U.S. Philips Corporation, New York, N.Y.

[21] Appl. No.: 547,883

[22] Filed: Jul. 2, 1990

[30] Foreign Application Priority Data

Jun. 30, 1989 [NL] Netherlands ..... 8901665
Jun. 8, 1990 [NL] Netherlands ..... 9001302

[51] Int. Cl.[6] ..... H05B 37/02

[52] U.S. Cl. ..... 315/149; 315/151; 315/158

[58] Field of Search ..... 315/151, 155, 315/158, 156, 149

[56] References Cited

U.S. PATENT DOCUMENTS 4,467,246 8/1984 Tanaka ..... 315/151
4,682,084 7/1987 Kuhnel ..... 315/151
4,922,089 5/1990 McGuire et al. ..... 315/151
4,922,154 5/1990 Cacoub ..... 315/155

*Primary Examiner*—Robert J. Pascal
*Assistant Examiner*—Reginald A. Ratliff
*Attorney, Agent, or Firm*—Brian J. Wieghaus

[57] ABSTRACT

The invention relates to a switching arrangement for operation of a high-pressure sodium discharge lamp by means of an adjustable power. Control of the adjustable power takes place by means of a control signal generated by optical sensing means for registering the spectral power of light emitted by the lamp. Registration of spectral power takes place in a first wavelength range between 350 nm and 800 nm.

7 Claims, 3 Drawing Sheets

SWITCHING ARRANGEMENT

BACKGROUND OF THE INVENTION

The invention relates to a switching arrangement or apparatus suitable for operating a high-pressure sodium discharge lamp by means of an adjustable power and provided with means for generating a control signal for controlling the adjustable power.

Such a switching arrangement is known from European Patent Application EP-A-240080, which corresponds to U.S. Pat. No. 4,952,864. In the known switching arrangement, the means for generating a control signal form a control signal dependent upon the lamp voltage. The adjustable power is controlled by means of the control signal in such a manner that the lamp voltage is constant by fair approximation. As a result, it is achieved that the colour temperature ($T_c$) of the light emitted by the lamp is controllable to some extent and is subject to variations only to a comparatively limited extent.

Limitation of variation of colour temperature is of particular importance for high-pressure sodium lamps, which emit "white light". In general, in these lamps it holds for the colour temperature ($T_c$) that $T_c$>2250 K. The range in the colour triangle within which the light of a high-pressure sodium discharge lamp is designated as "white", is limited by straight lines through points with coordinates (x, y): (0.400; 0.430), (0.510; 0.430), (0.485; 0.390) and (0.400; 0.360). The colour temperature may reach values of approximately 4000 K. in that case. Lamps of the kind described can be used to replace incandescent lamps.

A disadvantage of control of the colour temperature by means of the known switching arrangement is that the colour temperature depends only in part upon the lamp voltage. Especially sodium disappearance and hence variation of the amalgam composition of the lamp filling leads to variation of the colour temperature which cannot be controlled by means of control of the lamp voltage.

SUMMARY OF THE INVENTION

The invention has for its object inter alia to provide a means by which an improved control of the colour temperature can be obtained. According to the invention, this object is achieved in that a switching arrangement of the kind mentioned in the opening paragraph is characterized in that the means for generating the control signal comprise optical sensing means for spectral power registration of light emitted by the lamp in a first wavelength range lying between 350 nm and 800 nm.

The inventors have found that when registering in this manner the spectral power of the light emitted by the lamp, a signal can be produced which represents over a comparatively wide range a substantially linear relation between the colour temperature $T_c$ and the power supplied to the lamp. As a result, the generated signal is particularly suitable for use as a control signal. It has further been found that the control signal is substantially independent of the amalgam composition over a wide range. Likewise it has been found by the inventors that there exists a relation suitable for the control signal between the power supplied to the lamp and the x-coordinate of the colour point of the light emitted by the lamp. Since the y coordinate of the colour point of a high-pressure sodium lamp varies only slightly upon variation of the x coordinate, colour point control by this control signal leads also to colour temperature control.

Optical sensing means may be constituted by a photosensitive element having a suitable sensitivity characteristic. It is also possible that the sensing means are constituted by an assembly of an optical filter and a photosensitive element, which assembly has a desired sensitivity characteristic. The optical filter may itself be an assembly of filters.

In the present description and Claims, those wavelength values at which the sensitivity characteristic of optical sensing means has a value of 50% of the maximum sensitivity are regarded as the limits of the range in which these optical means register. It is conceivable for the sensitivity characteristic of the optical sensing means for the first wavelength range to extend over the whole first wavelength range. It has been found, however, that a sensitivity characteristic extending over a few tens to a few hundreds of nm is more suitable.

U.S. Pat. No. 4,012,668 discloses an arrangement for controlling the spectral output of a high-pressure discharge lamp by means of control of the power supplied to the lamp. This relates to a high-pressure metal halide lamp. The spectrum of such a lamp is formed to a considerable extent by discharge of mercury to which specific spectral contributions are added by the halide filling constituents present. There is a great variety in filling compositions each having a specific spectral distribution and a corresponding dependence on power input and on life.

In the arrangement known from the above US Patent Specification, registration in two wavelength ranges is necessary. To this end, the optical sensing means are provided with two comparatively broad-band filters which measure over the orange, yellow and red colour range and over the range of green and blue, respectively. By the use of the optical sensing means having such broad sensitivity bands, an accurate colour temperature control will be possible only under particular conditions.

By normalizing the registered power against the lamp power it is achieved that the switching arrangement is suitable for operating lamps of mutually differing power ratings without the necessity of individual calibration. The switching arrangement can thus be universally used. This is preferably achieved in that the means for generating the control signal also comprise optical sensing means for spectral power registration in a second wavelength range situated for the major part in the wavelength range of 500 nm to 780 nm.

The advantage of this preferred embodiment is that at least that part of the spectral power emitted by the lamp is used for normalization which accurately corresponds to the eye sensitivity and hence is a measure for the overall quantity of light emitted by the lamp. It is possible here for the sensing means covering the second wavelength range to register over a continuous range. It is alternatively possible, however, for the sensing means to register in a number of separate wavelength areas, for example 3, the sum of the registered quantities serving as a basis for normalization.

It is known that the sensitivity wavelength range of optical sensing means are subject to change, for example a shift, during life. Such a change is called drift. Drift will influence the accuracy of the colour temperature control realized by the switching arrangement. When the first wavelength range is chosen in the range from 500 nm to 700 nm, it is found that an accurate colour temperature control can be realized which has a comparatively low sensitivity to drift.

A further improvement, notably as regards the accuracy of the colour temperature control to be achieved, is possible when the means for generating the control signal also comprise optical sensing means for spectral power registration in a third wavelength range situated between 550 and 650 nm and separated for the major part from the first wavelength range. The inventors have found that by means of the results of the optical sensing means a signal can be obtained having the form $S=F_1-F_2+b$, where S=the signal, $F_1$=the power consumed in the first wavelength range, $F_2$=the power consumed in the third wavelength range, and a and b are constants.

$F_1$ and $F_2$ and hence S are dependent on the colour temperature and the x coordinate of the colour point of the light emitted by the lamp, respectively. By a suitable choice of a and b, the value of S is 0 for a desired colour temperature or x coordinate. The desired value of the colour temperature or x coordinate is then the colour temperature or x coordinate which is kept constant by means of the switching arrangement. It has been found that the constant a is independent of the amalgam composition. By normalizing $F_1$ and $F_2$ against the power in the second wavelength range, it is achieved that the signal is independent of the lamp power.

These and other aspects of the invention will be described more fully for an embodiment with reference to the drawing.

DESCRIPTION OF THE PREFERRED EMBODIMENTS

Figure 1:
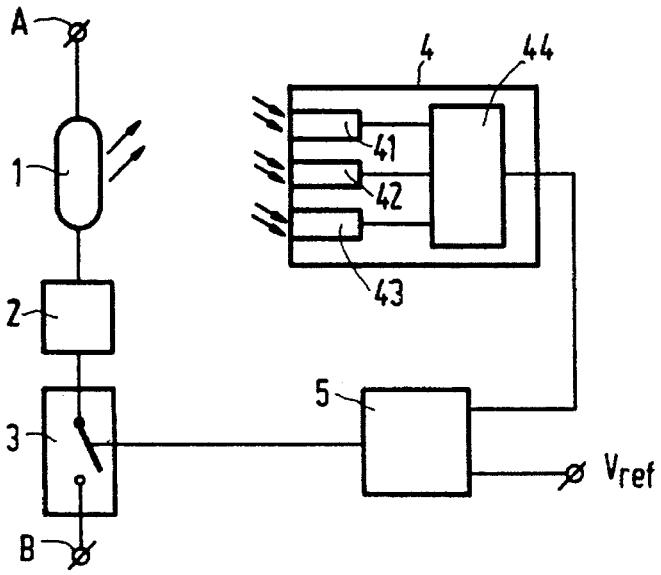
FIG. 1 shows a circuit diagram of a switching arrangement according to the invention provided with a high-pressure sodium discharge lamp.

FIG. 1 shows a high-pressure sodium discharge lamp 1 emitting "white light" and included in a switching arrangement for operating the lamp by means of an adjustable power. Terminals A and B serve for connection of the switching arrangement to a source of supply. Reference numeral 3 denotes switching, or power adjusting, means serving to control the power supplied to the lamp. A filter 2 is arranged between the switching means 3 and the lamp 1. In a practical embodiment, the source of supply was a 220 V, 50 Hz A.C. voltage source, the filter 2 was constituted by a stabilization ballast and the switching means 3 were constituted by a high-frequency switch in the form of a down converter.

The switching arrangement is further provided with means 4 for generating a control signal which is compared with a reference signal $V_{ref}$ in a control circuit 5. The result of the comparison in the control circuit 5 serves as a switching signal for the switching means 3. The means 4 for generating the control signal comprise optical sensing means 41, 42, 43 and a processing circuit 44, in which the control signal is generated from the signals originating from the sensing means 41, 42, 43. The optical sensing means may be arranged as separate sensing means, as is shown in FIG. 1. It is alternatively possible, however, that they are integrated into a single element. The optical sensing means have different sensitivity characteristics. The optical sensing means 41 serve for spectral power registration of the light emitted by the lamp in a first wavelength range lying between 350 nm and 800 nm. The second optical sensing means 42 serve for spectral power registration in a second wavelength range lying for the major part in the wavelength range from 500 nm to 780 nm. The third optical sensing means 43 serve for spectral power registration in a third wavelength range lying between 500 nm and 650 nm and substantially separate from the first wavelength range.

In a practical embodiment, the third optical sensing means 43 consisted of a combination of a diffusor, a monochromator having a low resolution and a photodiode. This combination resulted in an optical filter having a sensitivity characteristic of 570 nm to 620 nm. The first optical sensing means 41 consisted in this practical case of a combination of a diffusor, a glass filter BG 28, and a photodiode, resulting in a sensitivity characteristic of 380 nm to 480 nm. The second optical sensing means 42 consisted of a combination of a diffusor and a photodiode, resulting in a sensitivity characteristic of 500 nm to 950 nm.

Spectra were measured and analysed for a number of test lamps. The lamps concerned were lamps having a power rating of 50 W, each operated at powers with an adjustment between 20% overload and 20% underload. The spectrum of the emitted light and the x coordinate of the colour point were measured for each power setting.

The lamps were subdivided into five groups corresponding to differently chosen amalgam compositions according to the following summary:

| type No. | weight ratio mercury/sodium: |
|---|---|
| I | 40/18 |
| II | 40/15 |
| III | 40/13 |
| IV | 40/11 |
| V | 40/9. |

Figure 2:
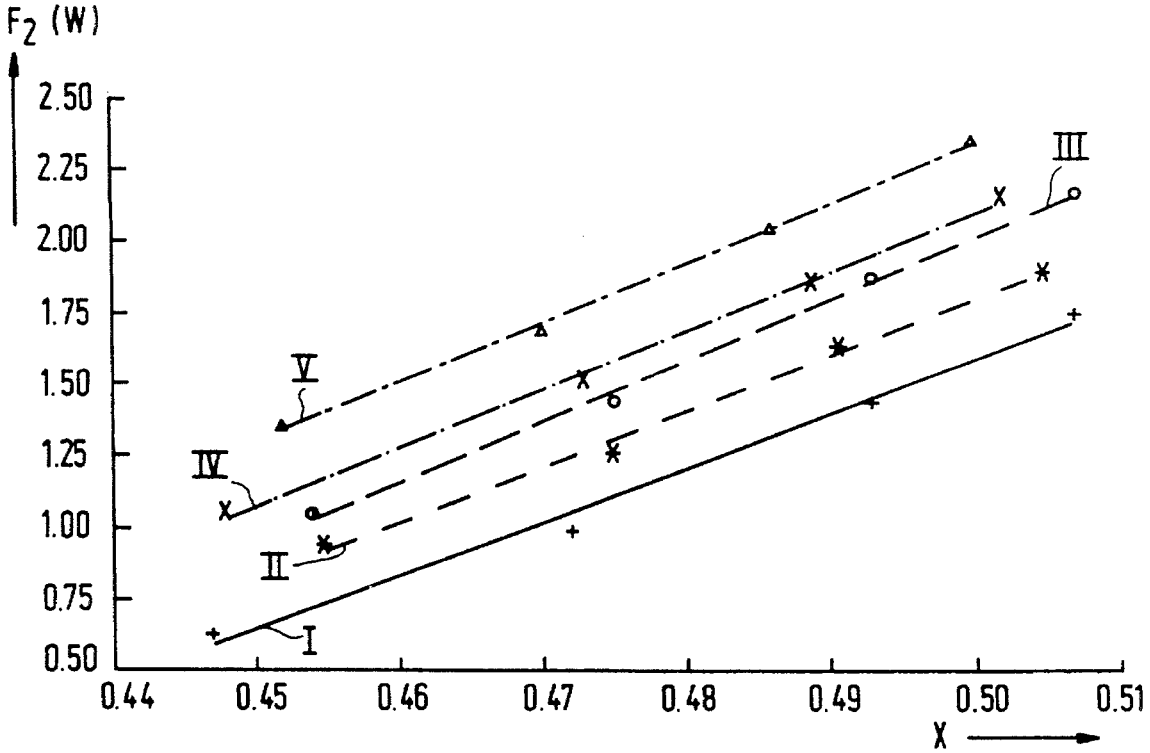
FIG. 2 shows emitted powers $F_2$ in a second wavelength range as a function of x coordinates of measured colour points.
Figure 3:
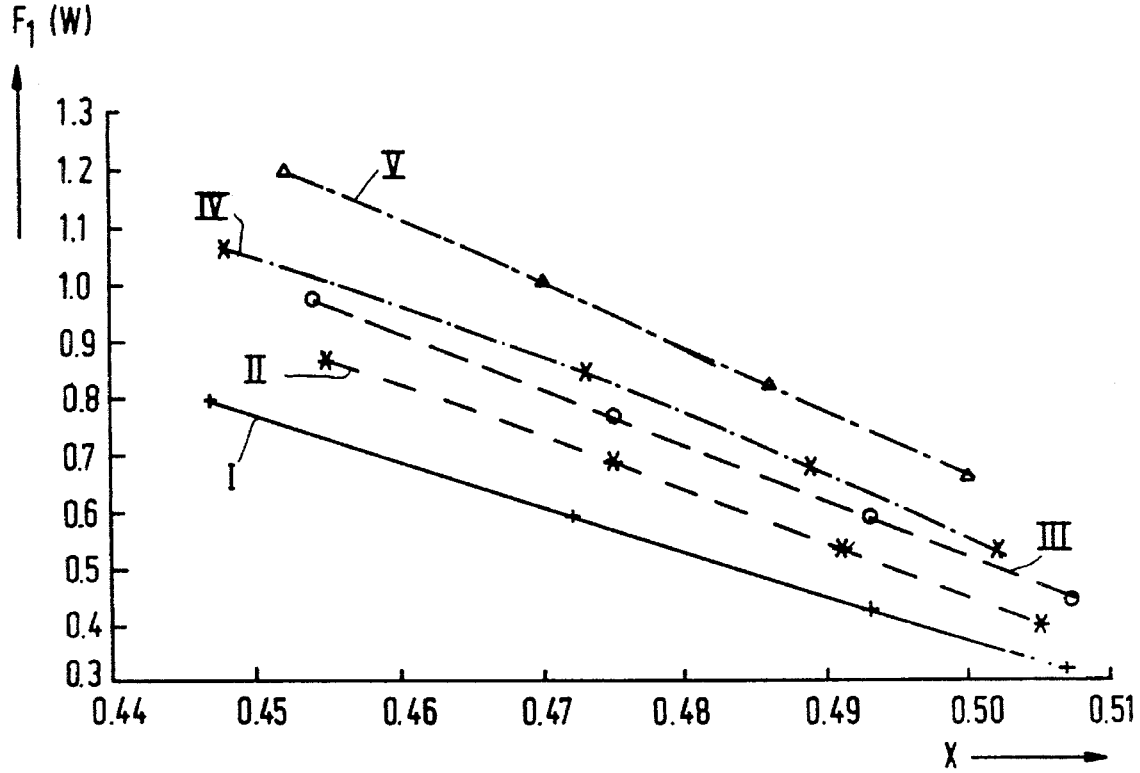
FIG. 3 shows emitted powers $F_1$ in a first wavelength range as a function of x coordinates of measured colour points.
Figure 4:
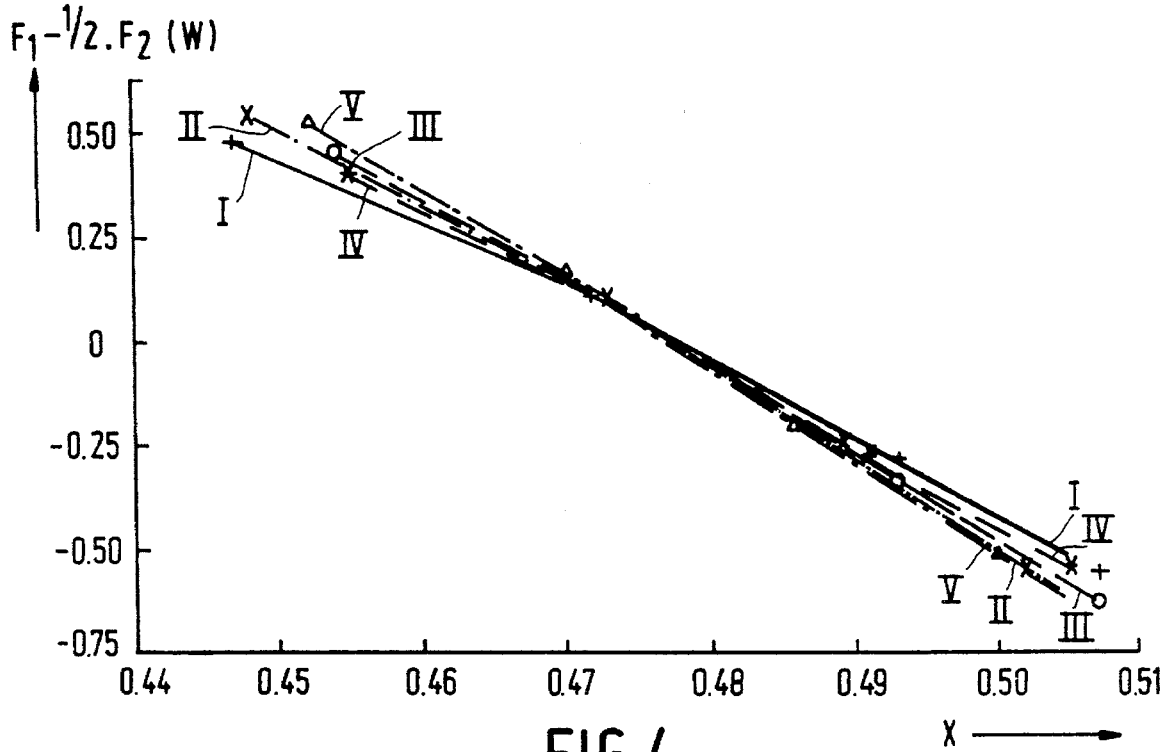
FIG. 4 shows powers $F_1-\frac{1}{2}.F_2$ as a function of x coordinates of measured colour points.

FIGS. 2 to 4 show results of an analysis of the spectra measured.

In FIG. 2, the spectral power $F_2$ emitted by the lamps in W is plotted on the ordinate, which spectral power is emitted in the wavelength range of 570 nm to 620 nm in the spectra measured. The x coordinate of the colour point is plotted on the abscissa.

The points in FIG. 2 associated with the same lamp type are interconnected by a line marked with the relevant type number.

In FIG. 3, the spectral power $F_1$ emitted in the wavelength range of 380 nm to 480 nm is shown in a corresponding manner.

Of the results as shown in FIGS. 2 and 3, the relation $F_1-\frac{1}{2}.F_2$ is then determined and shown in the graph of FIG. 4. Inspection of FIG. 4 shows that a signal generated according to the relation shown is very suitable as a control signal for colour point control. For a value of the x coordinate of 0.475, the result of the relation is substantially zero for each lamp type.

Figure 5:
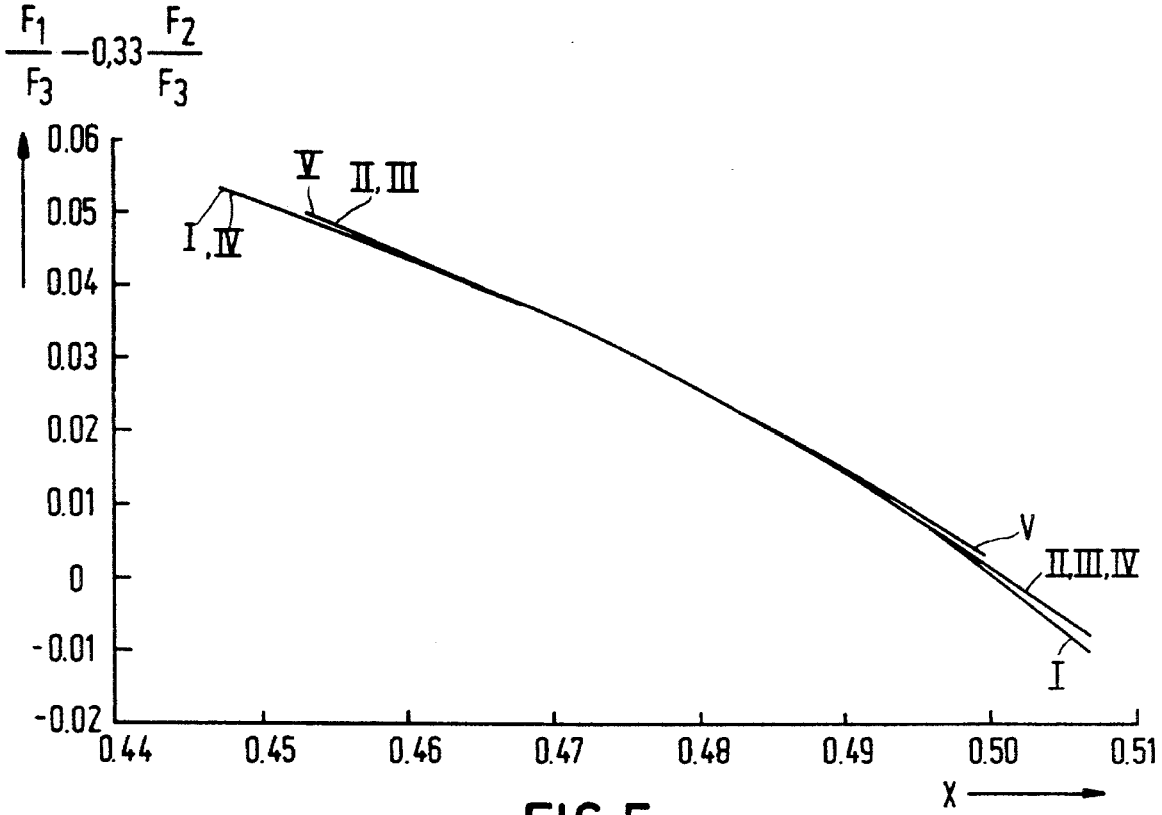
FIG. 5 shows powers $F_1-0.33.F_2$ normalized against powers $F_3$ as a function of x coordinates of measured colour points.

A further improvement with respect to suitability as a control signal is achieved by normalization of the results shown in FIG. 4 against a power $F_3$ proportional to the lamp power. FIG. 5 shows the result with normalization against the spectral power $F_3$ lying in the wavelength range of 380 nm to 780 nm.

The result shown in FIG. 5 satisfies the relation $$S_1 = \frac{F_1}{F_3} - 0.33\frac{F_2}{F_3} - 0.03$$

if the value of the x coordinate is chosen to be equal to 0.475.

Test lamps were operated on the switching arrangement shown in FIG. 1, the value of the x coordinate being chosen to be equal to 0.480. Of the lamps thus operated the colour point was measured and is shown by squares in the graph of FIG. 6, the x coordinate of the colour point being plotted on the abscissa and the y coordinate being plotted on the ordinate.

Moreover, the colour point of the same lamps was measured with operation at constant lamp voltage. The colour points thus measured are indicated by crosses in FIG. 6. Colour points associated with the same lamp are provided with the same numeral.

Figure 6:
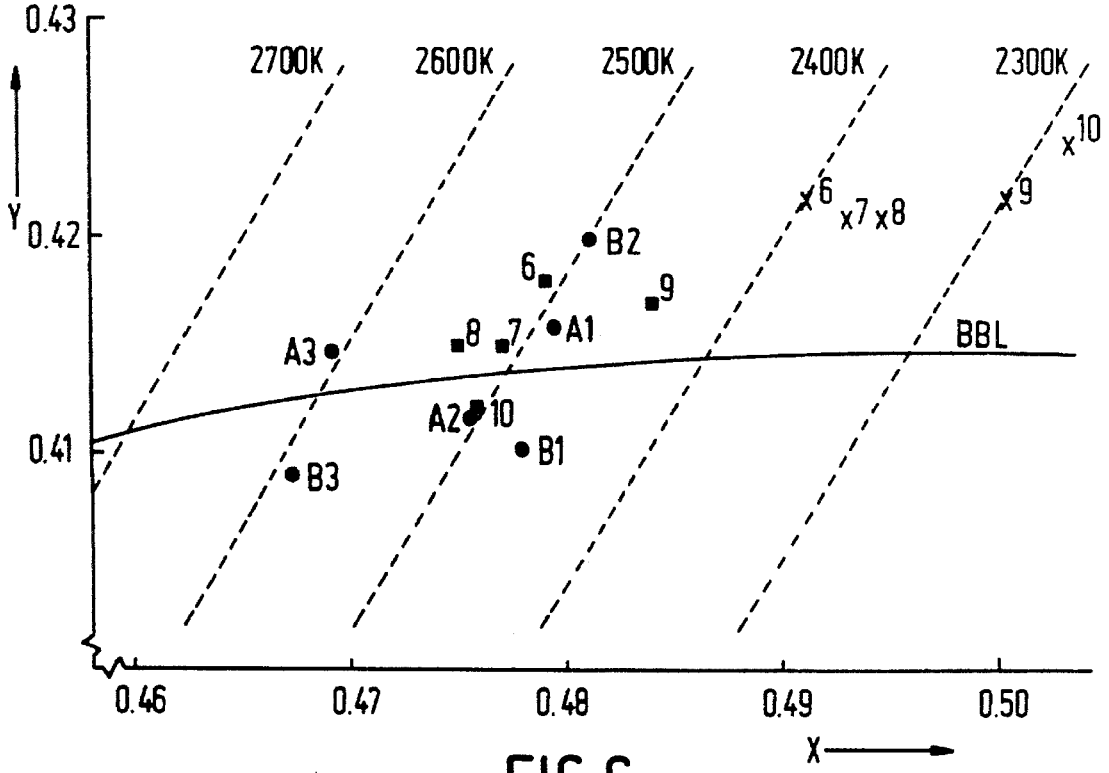
FIG. 6 shows measured colour points.

In FIG. 6, broken lines also indicate lines of constant colour temperature $T_c$. At each broken line the relevant value of $T_c$ is indicated in degrees K. In FIG. 6, the full line marked BBL indicates the black body line.

In another practical embodiment, in which the relation between optical power registration and colour temperature $T_C$ was used as a control signal, the optical sensing means consisted of a single sensor having three sensitivity ranges. The sensor was of the type AM33Sc-01, make Sanoy. The switching arrangement of which the sensor formed part was of an analogous construction to that of the switching arrangement as described for FIG. 1. Two lamps were operated with this switching arrangement, each with two different settings for the desired colour temperature. The sensitivity range from 610 nm to 640 nm served as the first wavelength range. Normalization took place by means of a signal obtained by summing the spectral power registrations in each of the sensitivity ranges of the sensor. The sensitivity ranges were the following wavelength ranges: 415 nm–445 nm; 515 nm–535 nm; and 610 nm–640 nm. The results are summarized in table I below.

TABLE I

| | 1 | 2 | 3 |
|---|---|---|---|
| lamp A | 2496 | 2503 | 2613 |
| lamp B | 2465 | 2501 | 2594 |

Column 1 gives the measured colour temperature $T_c$ in the case of operation on a known switching arrangement, whereas columns 2 and 3 give the measured colour temperatures $T_c$ in the case of operation on the switching arrangement according to the embodiment described. In column 2 the desired colour temperature was set for 2500 K., in column 3 for 2600 K.

Lamp A contained amalgam with a weight ratio mercury/sodium 40/15. This ratio was 40/11 in lamp B.

The colour points were also measured for the lamps operated in this way. They have been indicated with round dots in FIG. 6 with the reference symbols A1, A2 and A3 for lamp A and B1, B2 and B3 for lamp B.

The results of a further analysis carried out into the linear approximation of the relation between the colour temperature $T_c$ and the power supplied to the lamp are summarized below. To this end, the relation between the spectral power in a first wavelength range and the colour temperature is compared with the colour temperature calculated by a linear approximation. In the analysis, the spectral power in the first wavelength range is normalized against the power registered in a wavelength range from 500 nm to 950 nm. Twelve spectra from four different lamps were used for the analysis. The mercury/sodium weight ratio was different for the lamps and lay between 40/18 and 40/11.

The results are shown in Table II below. In this table, column 1 lists the extent of the first wavelength range expressed in nm. Column 2 contains the RMS value of the difference between the colour temperature $T_c$ measured and the colour temperature calculated according to the linear approximation, in K. Column 3 also gives the RMS value for this difference, but for the case in which the centre of the first wavelength range shows a drift of 1% of its value. This is a measure for the sensitivity to drift. Finally, column 4 shows the RMS value for the difference in x coordinate of the colour point of the lamp determined in a similar manner as in column 2.

TABLE II

| | 1 | 2 | 3 | 4 |
|---|---|---|---|---|
| 1. | 350–450 | 88 | 136 | 0.007 |
| 2. | 400–500 | 77 | 153 | — |
| 3. | 450–550 | 55 | 440 | 0.006 |
| 4. | 500–600 | 37 | 94 | 0.003 |
| 5. | 550–650 | 27 | 50 | 0.003 |
| 6. | 570–670 | 32 | 52 | 0.003 |
| 7. | 650–750 | 37 | 127 | 0.003 |
| 8. | 610–640 | 14 | 110 | 0.001 |
| 9. | 550–600 | 42 | 45 | 0.004 |
| 10. | 575–625 | 38 | 63 | 0.003 |
| 11. | 595–645 | 19 | 91 | 0.002 |
| 12. | 500–600 | 31 | 66 | — |

It should be noted that a colour point difference of 100 K. or less is usually not discernable to the human eye. Consideration of the RMS values in column 2 for the wavelength ranges with numerals 1 to 12 shows that a linear relation is a good approximation for the first wavelength range situated between 350 nm and 800 nm. A comparison of the ranges with numerals 1 to 7 and the accompanying RMS values in columns 2 and 3 shows that not only an accurate colour temperature control can be achieved, but also a comparatively low sensitivity to drift when the first wavelength range is chosen to be between 500 nm and 700 nm. A comparison of the results in the ranges with numerals 4 to 6 and 9 to 12 further shows that the combination of accurate colour temperature control and comparatively low sensitivity to drift obtains for a considerable variation in width of the first wavelength range.

The twelve spectra were also used to carry out a comparison between the measured colour temperature and the colour temperature calculated according to a linear relation in the case in which a third wavelength range is used. The ranges 550 nm–600 nm and 595 nm–645 nm were chosen in that order for the third wavelength range. In each of these ranges, the RMS value of the difference in colour temperature was ascertained for a number of ranges for the first wavelength range varying between 375 nm–425 nm and 700 nm–750 nm. The RMS value found lay between 41 K. when the first wavelength range was from 375 nm to 425 nm and the third wavelength range was from 550 nm to 600 nm, and 7 K. when the first wavelength range was from 600 nm to 650 nm and the second wavelength range was from 550 nm to 600 nm.

We claim:

1. A switching apparatus for controlling the color temperature of a high pressure sodium discharge lamp, said switching apparatus comprising:

power adjusting means for adjusting the electrical power to the high pressure sodium discharge lamp; and control means for controlling said power adjusting means, said control means comprising (i) optical sensing means for determining the x-coordinate of the color point of the light emitted by the high pressure sodium lamp, and (ii) correlating means for correlating the electrical power supplied to the high pressure sodium discharge lamp to the x-coordinate of the color point of the light emitted by the lamp.

2. A switching apparatus as claim in claim 1, characterized in that said optical sensing means comprises means for registering the spectral power of the lamp (i) is a first wavelength range lying between 350 and 800 nm and (ii) in a third wavelength range situated between 550 nm and 650 nm and separated for the major part from the first wavelength range, and said correlating means generates a signal S in the form $F_1-aF_2+b$, where $F_1$=the spectral power consumed in the first wavelength range;

$F_2$=the power consumed in the third wavelength range; and

"a" and "b" are constants selected such that S=O for a predetermined color temperature.

3. A switching apparatus as claimed in claim 1, characterized in that the first wavelength range is situated between 500 nm and 700 nm; whereby said optical sensing means for said first wavelength range has a low sensitivity to drift.

4. A switching apparatus as claimed in claim 3, characterized in that said optical sensing means further comprises means for spectral power registration in a second wavelength range situated between 500 nm and 780 nm, and said control means further comprises means for normalizing $F_1$ and $F_2$ against said spectral power measured in said second wavelength range.

5. A switching apparatus as claimed in claim 1, characterized in that said optical sensing means includes means (i) for spectral power registration in a first wavelength range between 350 nm and 800 nm, (ii) for spectral power registration in a second wavelength range between 500 and 780 and (iii) for spectral power registration in a third wavelength range situated between 550 nm and 650 nm and separated for the major part from the first wavelength range, said correlating means generates a signal S in the form $F_1-aF_2+b$, where $F_1$=the spectral power consumed in the first wavelength range;

$F_2$=the power consumed in the third wavelength range;

"a" and "b" are constants selected such that S=O for a predetermined color temperature; and means for normalizing $F_1$and $F_2$against said spectral power measured by said optical sensing means in said second wavelength range.

6. A controller for controlling the color temperature of a high pressure sodium discharge lamp, said controller comprising:

power adjusting means for controlling the electrical power to a high pressure sodium discharge lamp;

optical sensing means for registering spectral power of light emitted by the high pressure sodium lamp in a first wavelength range lying between 350 nm and 800 nm, in a second wavelength range between 500 nm and 780 nm, and a third wavelength range situated between 550 and 650 nm and separate for the major part from the first wavelength range; and control means for generating a control signal for the power adjusting means, said control means including means for generating a signal S in the form $F_1-aF_2+b$, where $F_1$=the spectral power consumed in said first wavelength range;

$F_2$=the spectral power consumed in said third wavelength range; and

"a" and "b" are constants selected such that S=O for a predetermined color temperature of the light emitted by the high pressure sodium discharge lamp, and means for normalizing $F_1$ and $F_2$ against said spectral power measured by said optical sensing means in said second wavelength range.

7. A controller according to claim 6, wherein said first wavelength range measured by said optical sensing means is between 500 and 700 nm.

* * * * *